US007478506B2

(12) United States Patent
Wendt et al.

(10) Patent No.: US 7,478,506 B2
(45) Date of Patent: Jan. 20, 2009

(54) CLIP FOR ATTACHING CEILING PANELS TO T-GRID

(75) Inventors: Alan C. Wendt, Barrington, IL (US); Martin E. Likozar, Richmond Heights, OH (US); James J. Lehane, McHenry, IL (US)

(73) Assignee: USG Interiors, Inc., Chicago, IL (US)

( * ) Notice: Subject to any disclaimer, the term of this patent is extended or adjusted under 35 U.S.C. 154(b) by 133 days.

(21) Appl. No.: 11/098,626

(22) Filed: Apr. 4, 2005

(65) Prior Publication Data

US 2006/0218871 A1 Oct. 5, 2006

(51) Int. Cl.
*E04B 9/00* (2006.01)

(52) U.S. Cl. ..... 52/506.07; 52/506.06

(58) Field of Classification Search ..... 52/506.07, 52/506.08, 506.09, 506.1, 506.06
See application file for complete search history.

(56) References Cited

U.S. PATENT DOCUMENTS 3,589,660 A * 6/1971 Dunckel ..... 248/343
4,055,930 A * 11/1977 Weinar et al. ..... 52/718.01
4,463,537 A * 8/1984 Rodriquez et al. ..... 52/506.07
4,535,580 A 8/1985 Shirey
4,696,142 A 9/1987 Mieyal et al.
4,736,564 A 4/1988 Gailey
5,609,007 A * 3/1997 Eichner ..... 52/747.1
5,845,447 A * 12/1998 Bodine et al. ..... 52/506.09
6,467,228 B1 10/2002 Wendt et al.

* cited by examiner

*Primary Examiner*—Brian Glessner
*Assistant Examiner*—Adriana Figueroa
(74) *Attorney, Agent, or Firm*—Pearne & Gordon LLP

(57) ABSTRACT

An adaptor clip, for converting a standard tee grid ceiling to a snap-up panel system, comprising an injection-molded plastic body that includes gripping elements for engaging the tops of the flanges of the tee grid and support elements for mating with the upstanding peripheral flanges of the snap-up panels. The clip is arranged to be quickly and easily installed without tools by simply positioning it against the lower faces of intersecting tee grid members so that its center underlies the center of the intersection and rotating it about a vertical axis.

4 Claims, 4 Drawing Sheets

CLIP FOR ATTACHING CEILING PANELS TO T-GRID

BACKGROUND OF THE INVENTION

The invention relates to suspended ceiling structures and, in particular, to a system for converting conventional T-grid for lay-in tiles to a snap-up panel construction.

PRIOR ART

Conventional suspended ceilings comprise a rectangular metal grid and lay-in tiles. Typically, the metal grid members have an inverted tee configuration and the tiles or panels are supported on the upper faces of the tee flanges. Situations arise where it is desirable to change the ceiling surface for various purposes such as to present a new appearance or look, or to conceal a soiled or otherwise damaged ceiling. The traditional approach to renewing the ceiling is to replace the tiles and either refurbish the lower visible faces of the grid tees or replace them. These approaches can be expensive considering the cost of new materials and installation labor, as well as the cost of handling and disposal of the old materials. Still further, replacement of existing ceiling tiles with new tiles does not yield a completely new "look" but, rather, only a renewed appearance.

U.S. Pat. Nos. 4,696,142 and 6,467,228 illustrate "snap-up" ceiling panels of a type used with the present invention.

SUMMARY OF THE INVENTION

The invention provides a system for resurfacing existing suspended ceilings that utilizes the original grid for support and allows the original tiles to remain in place. The disclosed resurfacing system provides a mounting clip with gripping elements that engage the existing grid and support elements that mate with peripheral portions of new ceiling panels. The mounting clip, in the illustrated embodiment, is configured to snap onto the flange of a standard tee or grid member and, more specifically, is configured to be installed at an intersection of the tee grid members such that it grips the adjacent flange areas at all four grid member extensions from the intersection.

As disclosed, moreover, the preferred clip is arranged to be manually installed without tools by simply twisting or rotating it about the center of the intersection, causing it to simultaneously grip onto all four grid extensions. A number of features allow the clip to be accurately positioned and readily snapped into place even where previously installed ceiling panels remain in place. The clip can beneficially be made by injection molding a suitable plastic material so as to achieve the resilience to enable it to reliably snap into the installed position. Moreover, the clip can be modified by cutting it with a hand shear or snips, without shattering or splitting, to fit areas where the grid members intersect walls, light fixtures, air vents, and the like.

DESCRIPTION OF THE PREFERRED EMBODIMENT

Figure 1:
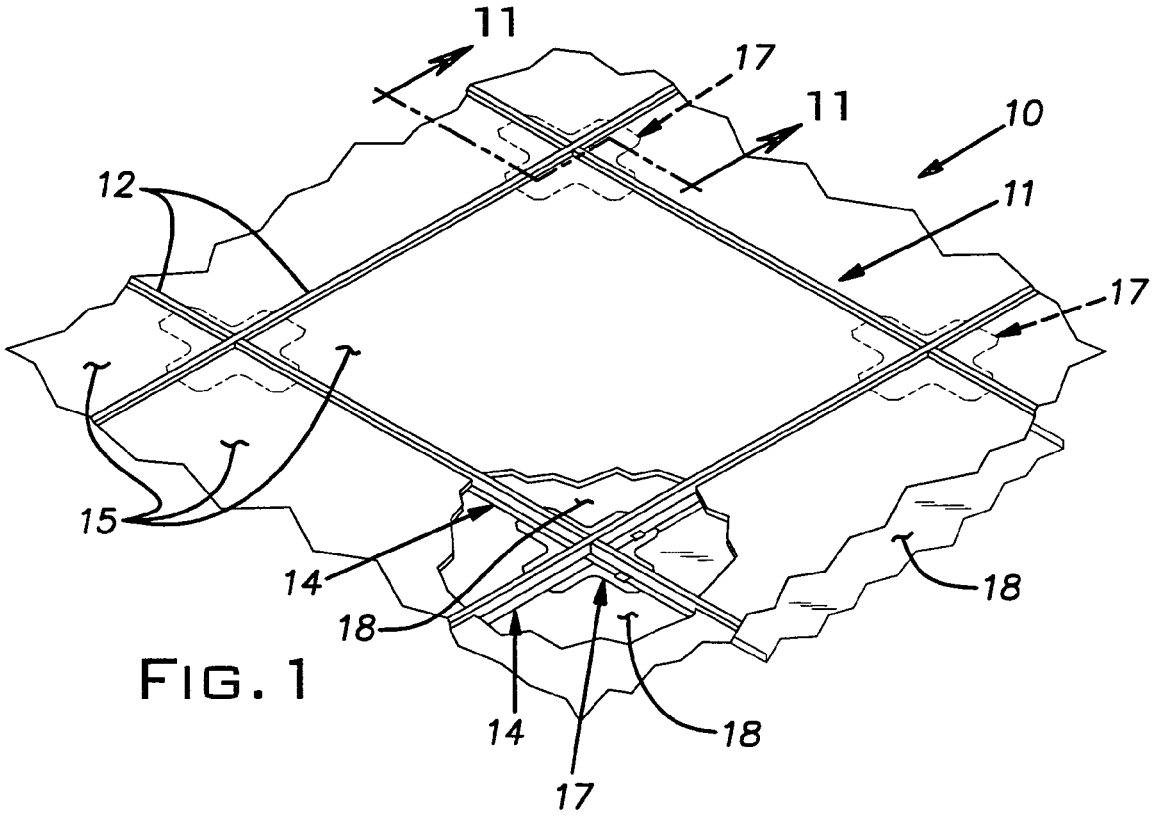
FIG. 1 is a perspective view of a suspended ceiling system, viewed from above, illustrating a conventional tee grid, lay-in tiles, an adaptor clip of the invention at the intersections of the grid tees, and snap-up panels supported on the tee grid by the adaptor clips.

FIG. 1 illustrates a suspended ceiling system 10 embodying the invention. The system includes a rectangular grid 11 formed of conventional main and cross tees 12. The rectangular grid 11 in the illustrated case forms square modules that are 2 foot by 2 foot, but it will be understood that the invention is applicable to other rectangular grid patterns such as the common 2 foot by 4 foot module. The cross tees or cross runners 12 intersect the main tees or main runners at regularly spaced locations along the lengths of the main tees and are coupled together with end connections of known construction. As is customary, the tees or runners have the general cross section of an inverted tee with a vertical stem or web 13 (FIG. 11) and a horizontal flange 14 at the lower edge of the stem. The flange 14 has symmetrical portions 16 each extending horizontally away from the stem 13. The width of the flange 14 of a common type of tee is nominally 15/16". At a regular tee intersection, four tee sections or portions extend horizontally outwardly from a theoretical center of the intersection. Typically, the sections of a main tee extend in opposite directions along one line and the sections of two cross tees extend in opposite directions along a line perpendicular to the line of the main tee.

Conventional ceiling tiles or panels 15 usually have acoustic and fire retardant properties and are normally supported on the grid tees 12 by resting in direct contact on the upper faces of the flange portions 16.

A plurality of clips or adaptors 17, installed on the tees or runners 12 at strategic locations, most typically at their intersections, are arranged to enable new ceiling panels 18 to be attached and supported on the grid 11 while, typically, previously installed tiles 15 remain on the grid 11. The illustrated clip 17 is a one piece injection molded body having a cruciform shape in plan view formed by four identical arms or sections 19. The major areas of the sections 19 are generally co-planar. The clip 17 can be formed of a suitable thermoplastic material such as a glass filled polybutylene tetra phthalate. This and like material has sufficient resilience to allow the clip to be installed and removed more than one time.

Figure 8:
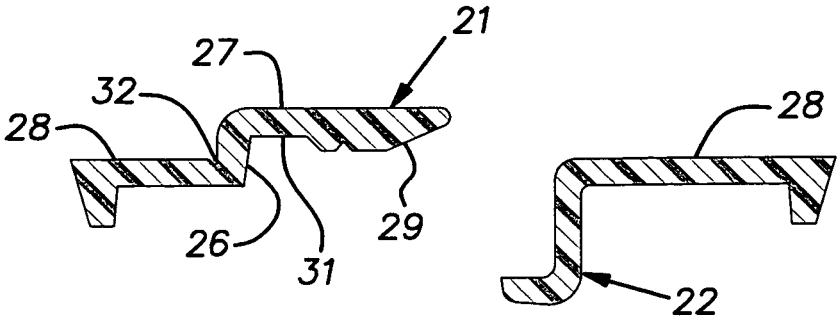
FIG. 8 is a cross-section of the adaptor clip taken along the lines 8-8 indicated in FIG. 6.
Figure 9:
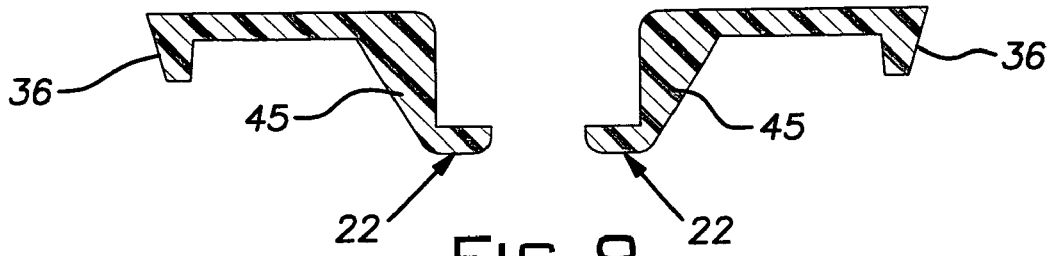
FIG. 9 is a cross-sectional view of the adaptor clip taken along the lines 9-9 indicated in FIG. 4, but shown upright.
Figure 10:
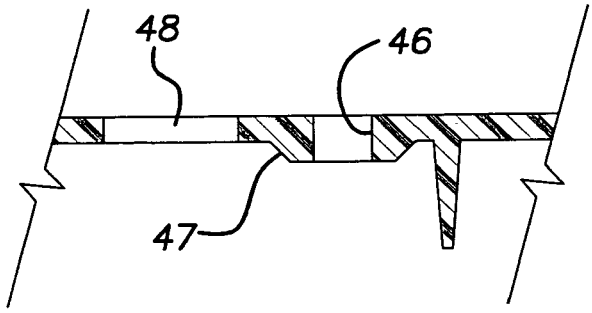
FIG. 10 is a fragmentary cross-sectional view of the adaptor clip taken along the lines 10-10 indicated in FIG. 6.

An upper face of the clip 17 has gripping elements 21 formed to interengage with the flange portions 16 of the grid tees 12 and a lower face of the clip has support elements 22 formed to mate with perimeter portions 23 of the ceiling panels 18. Each of the four arms or sections 19 of a clip body has a gripping element 21 arranged to engage and couple with a separate one of the four tee parts or sections of the grid 11 that comprise an intersection. The gripping or mounting element 21 as shown most clearly in FIG. 8, is L-shaped in cross-section with a short vertical leg 26 supporting a second cantilevered longer leg 27. The second or major leg 27 extends above an upper surface 28 of its respective body section 19 a distance about equal to and, preferably, slightly less than the thickness of the tee flange 14 to which it is to be mounted. A lower face of the horizontal leg 27, distal from the short vertical leg 26, is beveled at 29 and, proximal to the vertical leg 26 the lower surface is recessed at 31 vertically above the lowermost zone of the distal beveled part 29. A notch 32 at the juncture of the short vertical leg 26 and the planar section of the main body of the respective clip arm or section 19 enables the gripping or mounting element 21 to be manually broken off with thumb pressure for special applications or installations where it might otherwise interfere with a structure on which the clip 17 is to be mounted. The horizontal longer leg 27 of the gripping or mounting element 21 extends horizontally to a plane that is short of the center line of the arm or section 19 so that as discussed below, when properly installed on a grid tee flange 14, it does not interfere with the tee stem or web 13.

Figure 2:
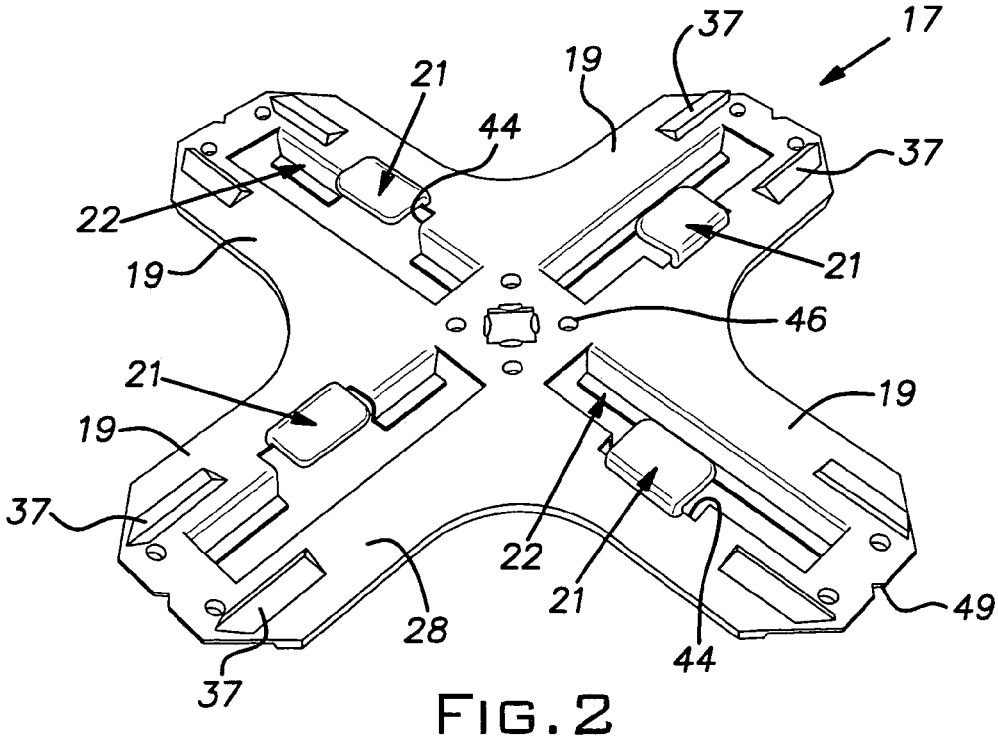
FIG. 2 is a perspective top view of the adaptor clip of the invention.
Figure 3:
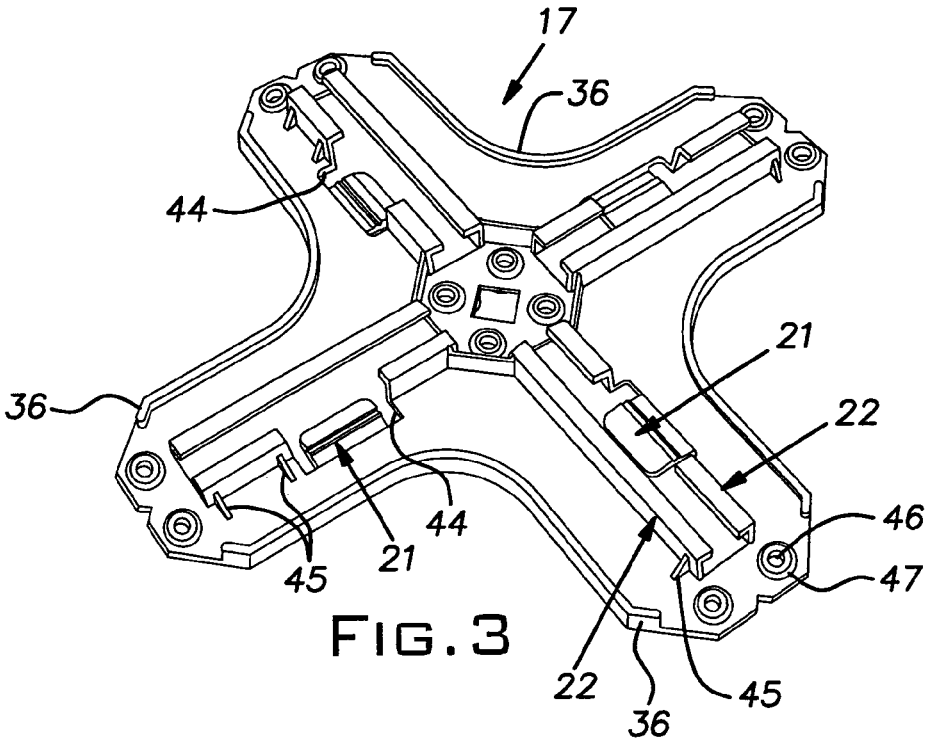
FIG. 3 is a bottom perspective view of the adaptor clip of the invention.
Figure 4:
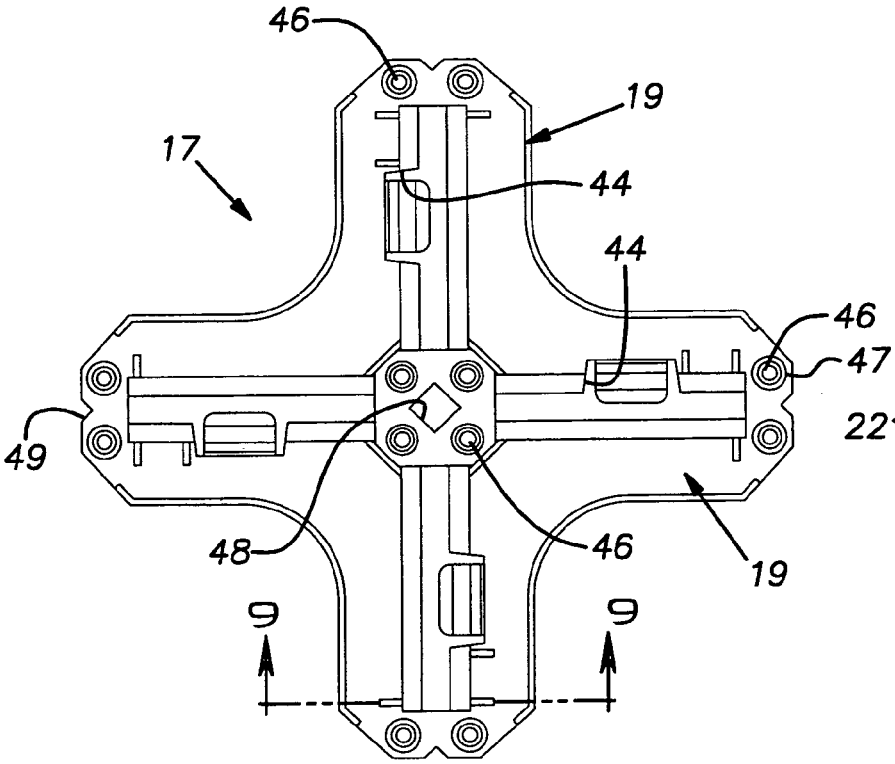
FIG. 4 is a bottom view of the adaptor clip.
Figure 5:
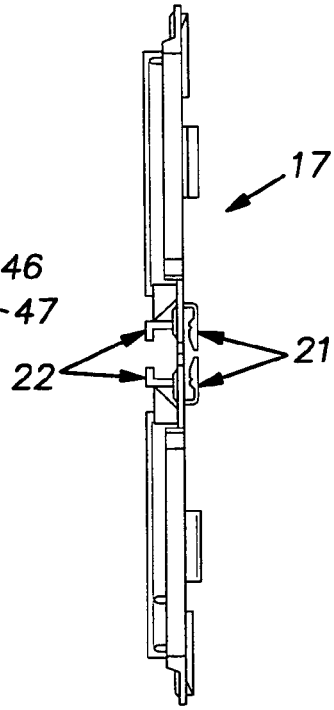
FIG. 5 is a side view of the adaptor clip.
Figure 6:
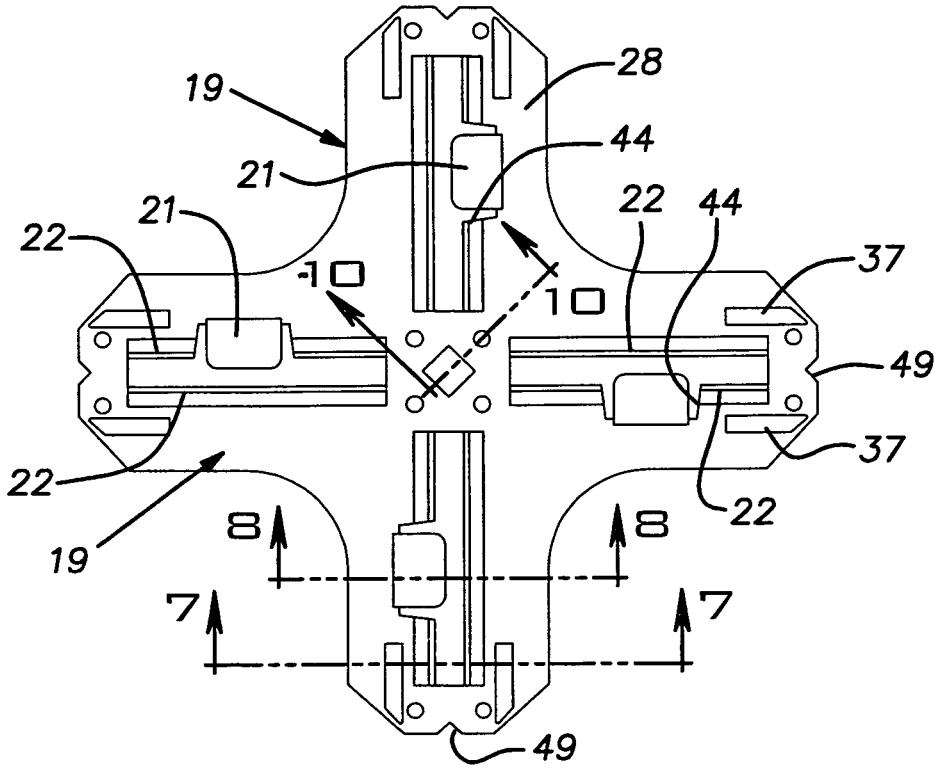
FIG. 6 is a top plan view of the adaptor clip.
Figure 7:
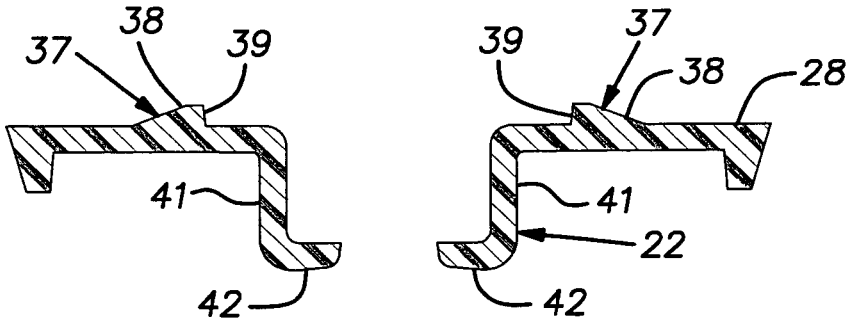
FIG. 7 is a cross-section of the adaptor clip taken along the lines 7-7 indicated in FIG. 6.

The perimeter of the clip 17 is reinforced and thereby stiffened by a downwardly extending flange 36. When the clip 17 is properly installed on the grid tees 12, central and outlying portions of the upper surface 28 are arranged to abut the lower face of the grid tee flanges 14. Centering rib formations 37 shown, for example, in FIGS. 2, 6, and 7, extend upwardly from the planar upper surface 28 and are symmetrically disposed on opposite sides of a center line of the respective clip arm 19. The ribs 37 each include a laterally outwardly facing inclined ramp surface 38 and a laterally inward facing alignment surface 39 having a relatively small tilt or draft of, for example, about 5 degrees.

Panel supporting elements or members 22 extend downwardly from the plane of the main body. The support elements 22 are symmetrically spaced on opposite sides of the center of the arms or sections 19. One of the support elements 22, on the side of the section 19 carrying the respective gripping element 21 is interrupted in the area of the gripping element such that it is in two parts spaced along the length of the respective section 19. Each support element 22 has an L-shaped section (e.g. FIG. 7) with a generally vertical leg 41 depending from the body proper of the associated section 19 and a horizontal flange or leg 42 extending from the vertical leg 41. The support elements 22 are stiffened by gussets 45. The gap between the support elements 22 is accompanied with a rectangular notch 44 in the main body of the section 19. The notch 44 permits the clip 17 to be molded with simple tooling that releases the clip with straight molding press platen opening motion without secondary slide action.

Holes 46 molded in the clip body adjacent the outward ends of the sections 19 and near the center of the body are provided to receive optional fasteners such as screws for fixing the clip 17 to a suspended grid or associated ceiling fixtures. The holes 46 are reinforced by concentric small annular flanges 47. A square hole 48 at the geometric center of the clip and notches 49 at the distal ends of the sections or arms 19 have corners lying on the center line of the respective sections. The corners of the hole 48 and notches 49 can be used as sights to align the clip 17 with a grid on which it is being installed or a chalk line or a laser beam, for example.

The clip 17 is manually installed, typically without tools, at an intersection of grid tees 12 from below the grid 11 by horizontally aligning its center with the imaginary center of the intersection while the top face 28 of the clip is held in contact with the lower faces of the grid tees and the sections 19 are deliberately held out of angular alignment, slightly counter-clockwise when viewed from below, with the lines of the grid tees.

The gripping elements 21, extending slightly above the plane of the main area of the clip body, raise the overlying tiles 15 that are carried on the respective grid tees 12. The clip 17 is rotated about its center on a vertical axis causing the gripping elements 21 to slide over portions 16 of the grid tee flanges 14. The beveled areas 29 smoothly cam the gripping elements 21 over respective tee flange portions 16. An audible click will be heard and resistance to further rotation will occur when the tee flanges 14 snap into the pocket formed between the opposing ribs 37 on each clip section 19. This snapping action is produced by the spring-like resilience of the gripping elements 21 and to some extent the resilience of the flanges 14 themselves. The tilt of each pair of alignment surfaces 39 tends to wedge the respective tee flange 14 into a snug and aligned fit there between. Once a flange 14 snaps between the surfaces 39, the force to remove a clip is greater than that required to install it. The location of the alignment surfaces 39, distal from the center of the clip 17 maximizes their position holding capacity. Fine adjustment of the clip position can be assisted by reference to the sights formed by the notches 49 and center hole 48, and any selected reference lines or marks.

In a typical application, clips 17 are installed on all of the grid tee intersections of an existing suspended ceiling. At the perimeter of the ceiling and other interruptions or terminations of the grid, such as at lighting and air duct fixtures, the clip 17 may be suitably field cut or otherwise modified to provide support elements 22 at these locations. Fasteners installed through the holes 46 of the modified clips can be anchored in corresponding areas of the overlying grid flanges 14 or other structure to maintain the modified clip in position.

Figure 11:
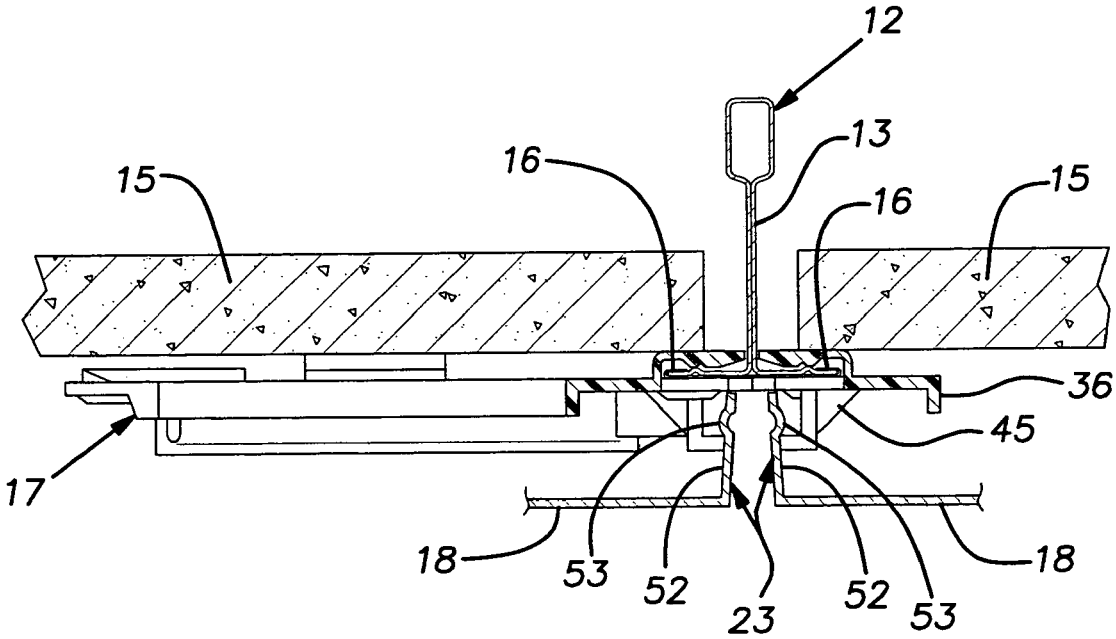
FIG. 11 is a fragmentary cross-sectional view of the ceiling installation taken along the staggered plane indicated by the lines 11-11 in FIG. 1.

With reference to FIGS. 1 and 11, the clips 17 enable new ceiling panels 18 to be installed on the grid 11 where, if desires, an earlier installation of ceiling tiles or panels 15 remain in place. It may be desirable to renew the appearance of a ceiling installation in which the ceiling panels and/or grid has been soiled with airborne dust and grime or otherwise become shopworn. U.S. Pat. Nos. 4,696,142 and 6,467,228 disclose types of ceiling panels that are compatible with the clip 17. The panels 18, typically formed of sheet metal, have peripheral vertically extending flanges 52. The panels 51 are proportioned so that the flanges 52 have re-entrant surface portions 53 that snap over the upper surfaces of the upturned edges 43 of the horizontal flanges 42 of the support elements 22. Normally, both the panel flanges 52 and the support elements 22 can be imparted with some relative resilience to permit this snapping action. Alternatively, a panel 18 or the support elements 22 can be designed to be the primary resilient element for this snapping action.

It will be understood that rectangular panels, other than the illustrated square panels 18, can be mounted on the clips 17. The clips 17 can be installed on less than all of the intersections of the grid tees 12 and can be installed on the grid tees between intersections. Thus, for example, 2 foot by 2 foot panels 18 can be installed on a 2 foot by 4 foot grid and, 2 foot by 4 foot panels can be installed on 2 foot by 2 foot grid patterns. Mounting the clips 17 at locations on an existing grid at locations other than intersections allows for re-squaring an out of square existing grid. The clips 17 can be installed along any grid tee 12 where additional panel support may be beneficial, for example, near the perimeter to support cut panels.

It should be evident that this disclosure is by way of example and that various changes may be made by adding, modifying or eliminating details without departing from the lair scope of the teaching contained in this disclosure. For example, the clip can be made of metal by blanking and forming, spot welding parts together, or casting. The invention is, therefore, not limited to particular details of this disclosure except to the extent that the following claims are necessarily so limited.

What is claimed is:

1. An adaptor for mounting rectangular ceiling panels on a suspended ceiling grid of inverted tee shaped grid members with generally horizontal flanges and vertical webs, the adaptor having gripping elements engaging upper surfaces of the grid tee flanges and panel support elements disposed below the gripping elements carrying the ceiling panels, the panel support elements engaging re-entrant surface portions on peripheral upstanding flanges of the ceiling panels and thereby transfer the weight of the panels through the adaptor to the suspended grid, the adaptor having four sections, each section having a cantilevered gripping element, each gripping element being spaced relative to the other gripping elements in a cruciform pattern, the gripping elements lying in a common horizontal plane and arranged to grip a separate one of four grid sections forming an intersection, the gripping elements all being cantilevered in the same direction in an angular sense about a center of the adaptor, said gripping elements being arranged to slip horizontally over a respective grid section when the adaptor, positioned from below the grid in an intermediate assembly position with the common horizontal plane of the gripping elements above a plane of the grid flanges, is rotated about a vertical axis coincident with a center of an intersection of grid sections, the gripping elements being cantilevered a distance substantially equal to the horizontal width of a grid flange from its web, the adaptor being devoid of structure, including any gripping element opposing each of said first mentioned gripping elements which could overlie the grid flange to the degree that said first mentioned gripping elements overlie the grid flange, in said common horizontal plane apart from said gripping elements which would prevent easy positioning of said adaptor in said intermediate assembly position, one set of the gripping elements being engaged with two grid sections lying along a common straight line and another set of gripping elements being engaged with two grid sections lying along a common straight line perpendicular to said first mentioned straight line, the panel support elements being arranged in oppositely facing pairs, two of said support element pairs straddling a line parallel to and directly vertically underlying said first mentioned straight line and another two of said support element pairs straddling a line parallel to and directly vertically underlying said perpendicular line.

2. An adaptor as set forth in claim 1, being an injection molded plastic part.

3. An adaptor as set forth in claim 2, configured such that a bottom side of said gripping elements are fully accessible from a lower face of the adaptor, and a top side of said support elements are fully accessible from an upper face of the adaptor, whereby said adaptor can be economically molded in relatively simple tooling without secondary slide action.

4. An adaptor for mounting rectangular ceiling panels on a suspended ceiling grid of inverted tee shaped grid members with generally horizontal flanges and vertical webs, the adaptor having gripping elements engaging upper surfaces of the grid tee flanges and panel support elements disposed below the gripping elements carrying the ceiling panels, the panel support elements engaging re-entrant surface portions on peripheral upstanding flanges of the ceiling panels and thereby transfer the weight of the panels through the adaptor to the suspended grid, the adaptor having cantilevered gripping elements spaced about a center of the adaptor, the gripping elements lying in a common horizontal plane, the gripping elements being cantilevered in the same direction in an angular sense about the center of the adaptor, said gripping elements being arranged to slip horizontally over respective grid section flange areas when the adaptor, positioned from below the grid in an intermediate assembly position with the common horizontal plane of the gripping elements above a plane of the grid flanges, is rotated about a vertical axis, the gripping elements being cantilevered a distance substantially equal to the horizontal width of a grid flange from its web, the adaptor being devoid of structure, including any gripping elements opposing each of said first mentioned gripping elements which could overlie the grid flange to the degree that said first mentioned gripping elements overlie the grid flange, in said common horizontal plane apart from said gripping elements which would prevent easy positioning of said adaptor in said intermediate assembly position, the gripping elements being engaged with two grid sections lying along a common straight line, the panel support elements straddling a line parallel to and directly vertically underlying said straight line.

* * * * *